US009579531B2

(12) United States Patent
Müller et al.

(10) Patent No.: US 9,579,531 B2
(45) Date of Patent: Feb. 28, 2017

(54) FIRE PROTECTION DEVICE FOR SMALL ELECTRICAL DEVICES

(71) Applicant: JOB Lizenz GmbH & Co. KG, Ahrensburg (DE)

(72) Inventors: Bodo Müller, Tornesch (DE); Jürgen Teschner, Hamburg (DE); Rüdiger Klug, Ahrensburg (DE)

(73) Assignee: JOB Lizenz GmbH & Co. KG, Ahrensburg (DE)

( * ) Notice: Subject to any disclaimer, the term of this patent is extended or adjusted under 35 U.S.C. 154(b) by 88 days.

(21) Appl. No.: 13/765,967

(22) Filed: Feb. 13, 2013

(65) Prior Publication Data

US 2013/0220650 A1 Aug. 29, 2013

(30) Foreign Application Priority Data

Feb. 24, 2012 (DE) ..... 20 2012 100 623 U

(51) Int. Cl.

| | |
|---|---|
| ***A62C 37/12*** | (2006.01) |
| ***A62C 37/14*** | (2006.01) |
| ***A62C 37/46*** | (2006.01) |
| ***A62C 37/48*** | (2006.01) |
| ***A62C 3/00*** | (2006.01) |
| ***A62C 35/10*** | (2006.01) |
| ***A62C 3/16*** | (2006.01) |
| ***H01H 37/76*** | (2006.01) |

(52) U.S. Cl.

CPC ..... *A62C 35/10* (2013.01); *A62C 3/16* (2013.01); *A62C 37/14* (2013.01); *H01H 37/761* (2013.01)

(58) Field of Classification Search

CPC .. Y10T 137/1639; F16K 17/383; A62C 3/006; A62C 3/00; A62C 2/242; A62C 2/241; A62C 2/243; A62C 37/46; A62C 37/48; A62C 37/11; A62C 37/12; A62C 37/14

USPC ..... 169/DIG. 3, 42, 38, 41; 137/67, 72

See application file for complete search history.

(56) References Cited

U.S. PATENT DOCUMENTS

| | | | | | |
|---|---|---|---|---|---|
| 3,889,755 | A | * | 6/1975 | Dunn | A62C 3/16 169/26 |
| 3,915,236 | A | * | 10/1975 | Stichling | 169/61 |
| 4,709,763 | A | * | 12/1987 | Jessick | A62C 35/10 169/26 |
| 5,627,719 | A | * | 5/1997 | Gaston | 361/103 |
| 5,890,543 | A | * | 4/1999 | Job | 169/37 |

(Continued)

FOREIGN PATENT DOCUMENTS

| | | |
|---|---|---|
| DE | 33 40 652 A1 | 5/1958 |
| DE | 94 02 661 | 4/1994 |

(Continued)

*Primary Examiner* — Arthur O Hall
*Assistant Examiner* — Christopher R Dandridge
(74) *Attorney, Agent, or Firm* — Sand & Sebolt

(57) ABSTRACT

A fire protection device for small electrical devices provided with a housing. The fire protection device includes a bursting capsule featuring a hollow space that is completely enclosed and delimited by a vessel wall, wherein a liquid is disposed in the hollow space. The liquid breaks the vessel wall at a predetermined trigger temperature due to thermal expansion thereby causing the bursting capsule to rupture. When the vessel wall ruptures and releases the liquid it has a fire preventing effect and/or a fire extinguishing effect.

8 Claims, 5 Drawing Sheets

(56) References Cited

U.S. PATENT DOCUMENTS

| | | | | |
|---|---|---|---|---|
| 5,967,238 | A * | 10/1999 | Pepi | A62C 37/14 169/37 |
| 6,189,624 | B1 * | 2/2001 | James | A62C 13/74 169/61 |
| 6,810,964 | B1 * | 11/2004 | Arnot | A62C 13/22 169/26 |
| 7,182,143 | B2 * | 2/2007 | Hall et al. | 169/26 |
| 7,343,981 | B2 * | 3/2008 | Nappa et al. | 169/46 |
| 8,402,985 | B2 * | 3/2013 | Schmalfuss | A62C 37/14 137/67 |
| 8,714,180 | B2 * | 5/2014 | Klug | A62C 37/14 137/67 |
| 2004/0194976 | A1 * | 10/2004 | Kretzschmar | A62C 37/14 169/42 |
| 2006/0016608 | A1 * | 1/2006 | Simpson et al. | 169/56 |
| 2009/0050339 | A1 * | 2/2009 | Calabrese | 169/61 |
| 2010/0307605 | A1 * | 12/2010 | Schmalfuss | 137/72 |

FOREIGN PATENT DOCUMENTS

| | | | |
|---|---|---|---|
| DE | 100 56 778 | A1 | 9/2002 |
| DE | 20 2011 050 661 | | 9/2011 |
| EP | 0094192 | | 11/1983 |
| EP | 0 838 242 | | 6/2002 |
| EP | 2541666 | | 1/2013 |
| WO | 88/06046 | | 8/1988 |
| WO | 97/26945 | | 7/1997 |
| WO | 02/40101 | | 5/2002 |

* cited by examiner

FIRE PROTECTION DEVICE FOR SMALL ELECTRICAL DEVICES

BACKGROUND OF THE INVENTION

Technical Field

The invention relates to a fire protection device for small electrical devices having housings. It also relates to a small electrical device with a housing that is equipped with such a fire protection device. Finally, it relates to the use of a bursting capsule as a fire protection device for small electrical devices.

Background Information

Small electrical devices for the purposes of this invention are devices with small dimensions that operate using electric power, wherein small dimensions are understood to mean edges that are a maximum of 1 m in length, typically in a range of several cm to several dm. For example, a typical small electrical device is a power adaptor as is often currently used in conjunction with laptop computers. These kinds of power adaptors have dimensions of 10 cm to 15 cm along its longest edge length and up to 10 cm along its shortest edge length. Encapsulated in a housing, they contain electrical components for the voltage conversion of a supply voltage originating from the mains voltage, for example 230V AC in Europe, into a supply voltage for the electrical device being supplied, for example a laptop, e.g. a DC voltage of 12 V.

These kinds of small electrical devices, for example such power adaptors, heat up during operation. If there is any damage, this kind of small electrical device, such as a power adaptor, can overheat, for example as a result of a short circuit or an overload that is not adequately absorbed by a corresponding safety device, which under unfavorable circumstances can lead to the plastic components in the small electrical device catching fire, and can thereby lead to a fire. Various house and apartment fires, or fires in office buildings, are caused by defective electrical devices that catch fire as a result of such malfunctions.

Although such small electrical devices are frequently equipped with electrical fuses that are tripped in the event of a defect and a resulting overcurrent, and that are supposed to cut the power supply, such fuses are not always adequate protection against a fire in this kind of small electrical device. In particular, such fuses can no longer provide effective protection if excessive overheating of the small electrical device, or of the electrical components in the small electrical device, has already occurred before the fuse is tripped.

BRIEF SUMMARY OF THE INVENTION

The invention is intended as a remedy for this by providing a reliable fire protection device for small electrical devices with a housing.

According to the invention, such a fire protection device consists of a bursting capsule featuring a hollow space that is completely enclosed and delimited by a vessel wall, wherein a liquid that exhibits two essential characteristics is disposed in the hollow space. This liquid breaks the vessel wall at a predetermined trigger temperature due to thermal expansion, thereby causing the bursting capsule to rupture. Furthermore, the liquid has a fire inhibiting effect and/or an extinguishing effect.

Thus the fire protection device according to the invention functions as follows: Based on a predetermined trigger temperature, the fire protection device monitors whether the small electrical device exceeds the maximum permitted temperature, specifically the trigger temperature, and if the small electrical device overheats, or in other words the inner temperature inside the housing in which the fire protection device is disposed exceeds the trigger temperature, the fire protection device is triggered, namely by the rupture of the bursting capsule. The liquid that escapes the bursting capsule then provides a fire inhibiting effect or an extinguishing effect. In this way, smoldering fires that have already begun inside the small electrical device can be extinguished when the trigger temperature is reached, if necessary, or in the case of a risk of smoldering fire, said fire can be prevented due to the fire-inhibiting effect of the liquid.

Bursting capsules, like those used for fire protection according to the invention, are known from the prior art in different variations. Particularly suited are the so-called glass vessels or glass tube sections that are sealed at both ends, such as those that are used in the release valves of sprinkler systems for example. There, corresponding glass vessels are placed between a support and an external cap on sprinkler system. They are filled with a triggering liquid, which causes the glass vessel to rupture due to thermal expansion when a trigger temperature is exceeded, wherein the bursting or rupture of the glass vessel releases the sprinkler system valve, thereby opening the sprinkler valve. In this application, the liquid functions solely as a thermal trigger, and the liquid is selected accordingly. A fire inhibiting effect and/or an extinguishing effect is not important for the triggering liquid, and known triggering liquids do not exhibit such an effect.

In the fire protection device according to the invention, in addition to the liquid, a gas bubble is advantageously disposed in the hollow space. This gas bubble may be an air bubble, for example, but may also be a gas that does not promote fire such as nitrogen or carbon dioxide. Such a gas bubble can be used to precisely set the trigger temperature of the bursting capsule.

According to another advantageous embodiment of the invention, the boiling point of the liquid is at a temperature that falls below the trigger temperature. As a result, the liquid released after the bursting capsule ruptures immediately vaporizes or transitions to the gaseous phase. Due to of the massive expansion of the material when it transitions to the gas phase (in the case of an ideal gas, one mole of such a gas would take up a volume of approximately 22.4 liters under normal conditions), the gas formed by the liquid would quickly fill the interior of the housing of the small electrical device and can exert a preventative effect and/or extinguishing effect. This extinguishing effect or fire inhibiting effect may take the form of displacing the oxygen needed by any type of fire in the housing of the small electrical device, for example. The effect may also take the form of homogeneous inhibition.

Another form of extinguishing effect, for which it is not necessary to select a liquid that has a boiling point that falls below the trigger temperature, may consist of a liquid that turns into foam when it is released, thereby developing an extinguishing property. This kind of foam formation may occur as a result of a reaction with components in the atmosphere within the small device, for example, or it may occur when the liquid encounters a second liquid component, for example when these are held separately in the bursting capsule and are only combined when the vessel has ruptured.

Another possible extinguishing effect can arise when the liquid exhibits a high bonding affinity with oxygen and therefore bonds chemically with oxygen, even as droplets of liquid distributed in the interior of the small appliance, thus withdrawing the oxygen from the seat of the fire. In this case, liquid can exhibit the extinguishing effect even without vaporizing, and need not have a boiling point that falls below the trigger temperature. Liquids that are suitable for the purpose of the protection device according to the invention include halons. Moreover, fluorinated ketones can also be used, especially a perfluorinated ethyl isopropyl ketone.

An additional protective function arises for the fire protection device according to the invention when an electrical conductor is routed between two contact points formed on the bursting capsule, which electrical conductor is designed in such a way that it is destroyed when the bursting capsule ruptures. In particular, such a conductor can be interconnected in the small electrical device so that it conducts the voltage supply. Thus the conductor constitutes an independent safety element since, in the event that the bursting capsule is triggered, the electrical conductor is destroyed and the power supply to the small electrical device is cut off. Thus, in addition to the fire inhibiting effect or extinguishing effect of the liquid that is released when the bursting capsule is triggered or ruptured, it is also ensured that electrical energy is no longer supplied to the small electrical device, and therefore no further heating is caused by this electrical energy, or the malfunctioning of the small electrical device, with a resulting increased risk of fire. Here, the electrical conductor can be designed in such a way that it serves as electrical overload protection, independent of the triggering of the fire protection device (the rupturing of the bursting capsule). For example, the conductor may be designed in such a way that it melts or is otherwise destroyed when the current exceeds a predetermined upper limit, thereby interrupting the power supply, even if the bursting capsule is still intact.

An additional aspect of the invention teaches of a small electrical device with a housing, in which electrical components are disposed and furthermore in which a fire protection device as described above is disposed. A small electrical device thus equipped is protected from a possible fire, for example a smoldering fire in the housing as a result of the effects described above. In particular, the small electrical device can be designed in such a way that its electrical supply line is connected to the contact points of the bursting capsule and routed through the conductor that is routed between these contact points. The result is the above-described additional safety effect.

An additional aspect of the invention relates to the use of a bursting capsule, with the various possible characteristics described above, as a fire protection device for a small electrical device, by disposing said bursting capsule in the housing of such a small electrical device.

BRIEF DESCRIPTION OF THE SEVERAL VIEWS OF THE DRAWINGS

Further advantages and characteristics of the invention will become apparent in the following description of possible embodiments with reference to the accompanying figures. These include.

The figures show possible schematic representations of embodiments of the invention. The figures are not at all drawn to scale and do not show all details; rather, these are schematic diagrams intended to illustrate the essential features of the invention in conjunction with the following description of the embodiments.

DETAILED DESCRIPTION OF THE INVENTION

Figure 1:
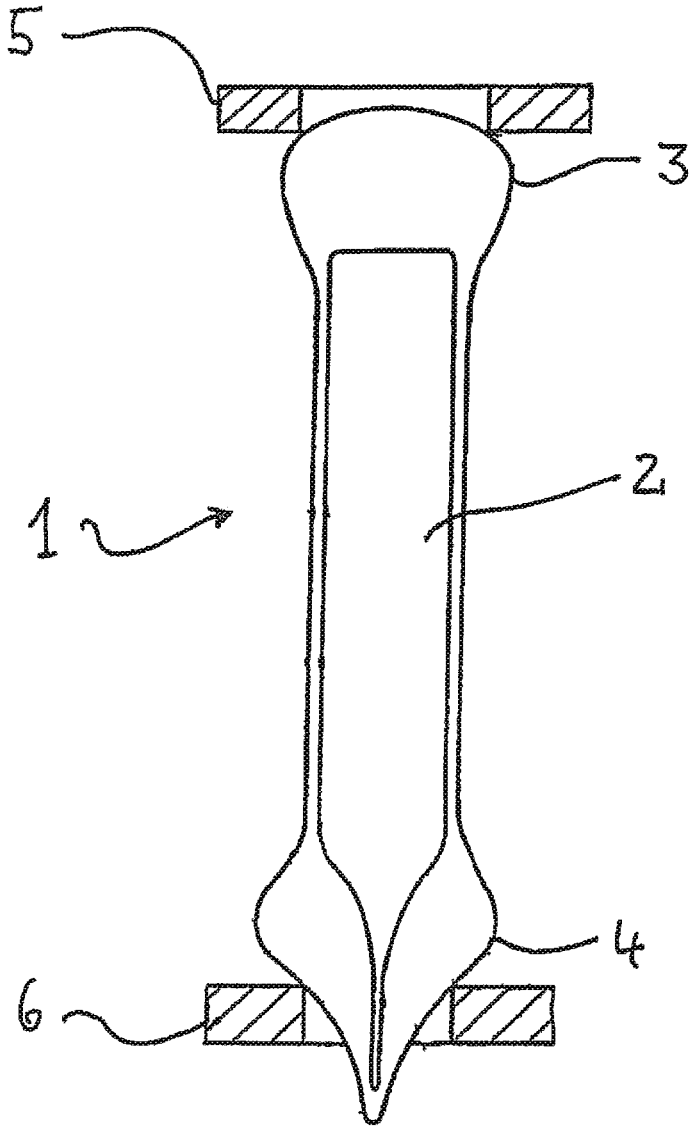
FIG. 1 a schematic view of a possible fire protection device according to the invention.

FIG. 1 is a schematic diagram of a bursting capsule 1, which is an essential component of a fire protection device according to the invention. The interior of this bursting capsule 1, which here is a so-called glass vessel formed from a glass tube, features a hollow space 2 that is completely enclosed by the vessel wall. The bursting capsule 1 is essentially cylindrical in shape with two thickened ends 3, 4. The bursting capsule 1 is disposed and is held between two supports 5, 6 at the ends 3, 4. A liquid is disposed in the hollow space 2 (not shown here), which, together with a small gas bubble, nearly fills the volume of the hollow space 2. On the one hand, this liquid is selected such that it causes the bursting capsule 1 to rupture at a predetermined trigger temperature due to thermal expansion, for example 50° C., 60° C., 65° C., 70° C. or 90° C., and on the other hand, such that it exhibits a fire inhibiting effect and/or an extinguishing effect. In this way, when the trigger temperature is reached or exceeded, the liquid in the bursting capsule is released when the vessel ruptures, and can achieve the desired fire inhibiting effect or extinguishing effect inside the housing of a small electrical device.

The liquid here is selected in an advantageous manner so that its boiling point is at a temperature that falls below the trigger temperature, or in other words that abruptly enters the gas phase when it is released upon reaching or exceeding the trigger temperature and therefore takes up a greater volume than the volume of the hollow space 2. Thus a comparatively small quantity of liquid can fill a comparatively large volume within the housing of a small electrical device with the corresponding gas, which arises from the liquid and therefore can achieve the fire inhibiting effect or extinguishing effect there.

A halon may be considered as a possible liquid in the hollow space 2. A fluorinated ketone is also suitable however, wherein in this embodiment, a perfluorinated ethyl isopropyl ketone according to the following structural formula

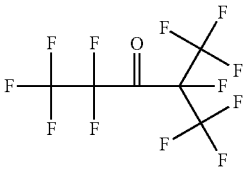

is preferable.

Figure 2:
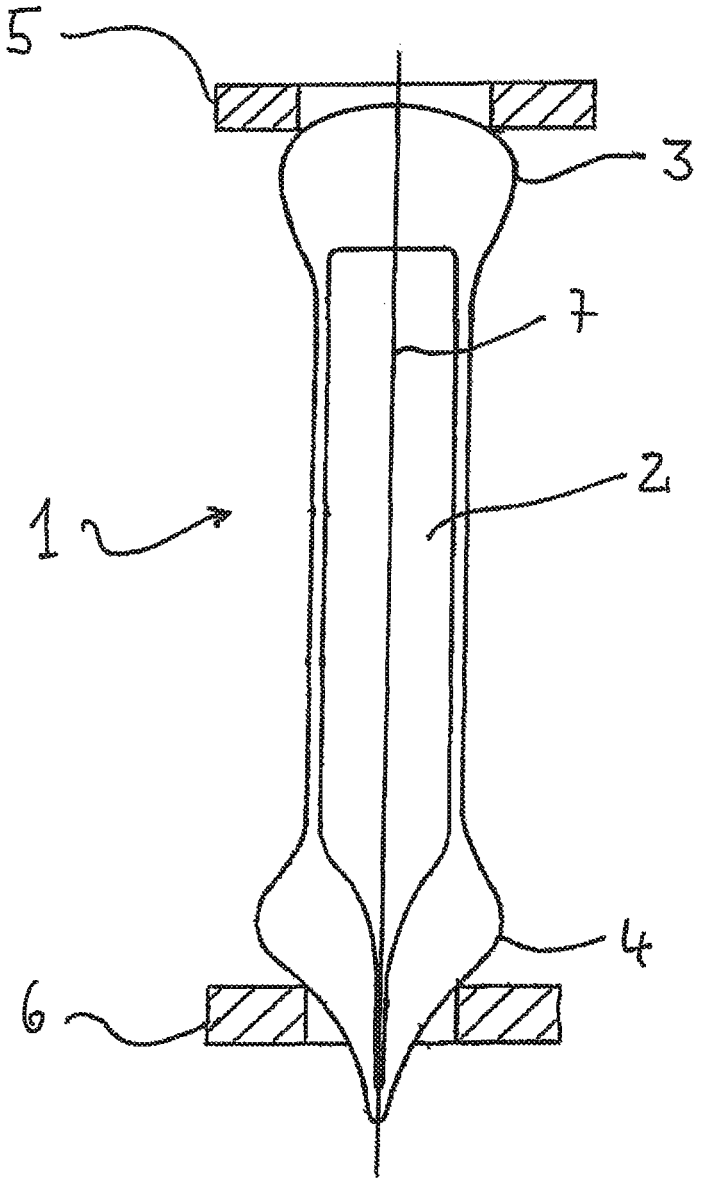
FIG. 2 a view similar to that in FIG. 1 showing an alternative embodiment of a fire protection device according to the invention.

FIG. 2 shows an alternative embodiment of such a bursting capsule 1 as a fire protection device. The primary components are essentially the same as those in the bursting capsule 1 in FIG. 1, and it simply includes an additional electrical conductor 7, which runs along the longitudinal axis of the bursting capsule 1, through the hollow space 2 and passes out through the respective ends 3 and 4. When this bursting capsule is used, this electrical conductor can be used as a fire protection device, for example, in order to conduct a supply voltage for the small electrical device. In so doing, the thickness of the electrical conductor 7 is selected in such a way that the electrical conductor 7 breaks, and is destroyed when the bursting capsule 1 ruptures as a result of the trigger temperature being exceeded. The result is that, in the event of triggering, not only is the fire inhibiting effect or extinguishing effect of the liquid contained in the hollow space 2 triggered or achieved, but at the same time the power supply to the electrical device is also cut off. Otherwise, the structure of the bursting capsule shown in FIG. 2 is the same as that in FIG. 1 and the functioning is identical as well.

Figure 3:
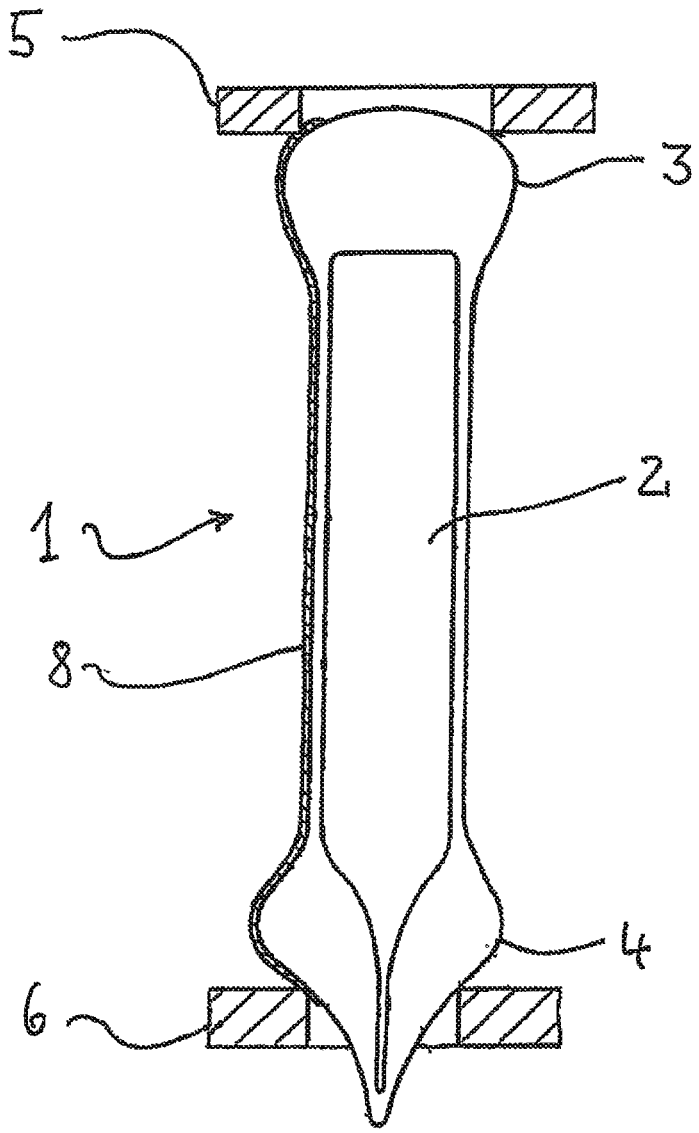
FIG. 3 a view similar to that in FIG. 1 showing another alternative embodiment of a fire protection device according to the invention.

FIG. 3 shows a further alternative of a bursting capsule 1, which in turn is essentially designed and functions as described in FIG. 1. In deviating from the embodiment shown in FIG. 1, in the case of the bursting capsule 1 according to FIG. 3, an electrically conductive coating 8 has been applied to a section of the exterior of the bursting capsule, which extends from one end 3 of the bursting capsule 1 to the other end 4. Contact can be established with this electrically conductive coating 8 via the supports 5 and 6, which come into contact with the coating 8 as shown, thereby forming an electrical conductor that runs along the longitudinal axis of the bursting capsule 1 and can be routed through an electrical supply of the small electrical device, for example. Here again, the rupture of the bursting capsule 1 as a result of pressure due to the thermal expansion of the liquid in the hollow space 2 when it exceeds the trigger temperature, which pressure the wall of the bursting capsule 1 cannot withstand at or above the trigger temperature, results in a break in the conductor formed by the electrically conductive coating 8 and therefore to an interruption in the current or voltage supply of the small electrical device equipped with this fire protection device. Otherwise, the structure and functioning of the bursting capsule shown in FIG. 3 is the same as that in FIG. 1, so that again, reference can be made to the description of this figure.

Figure 4:
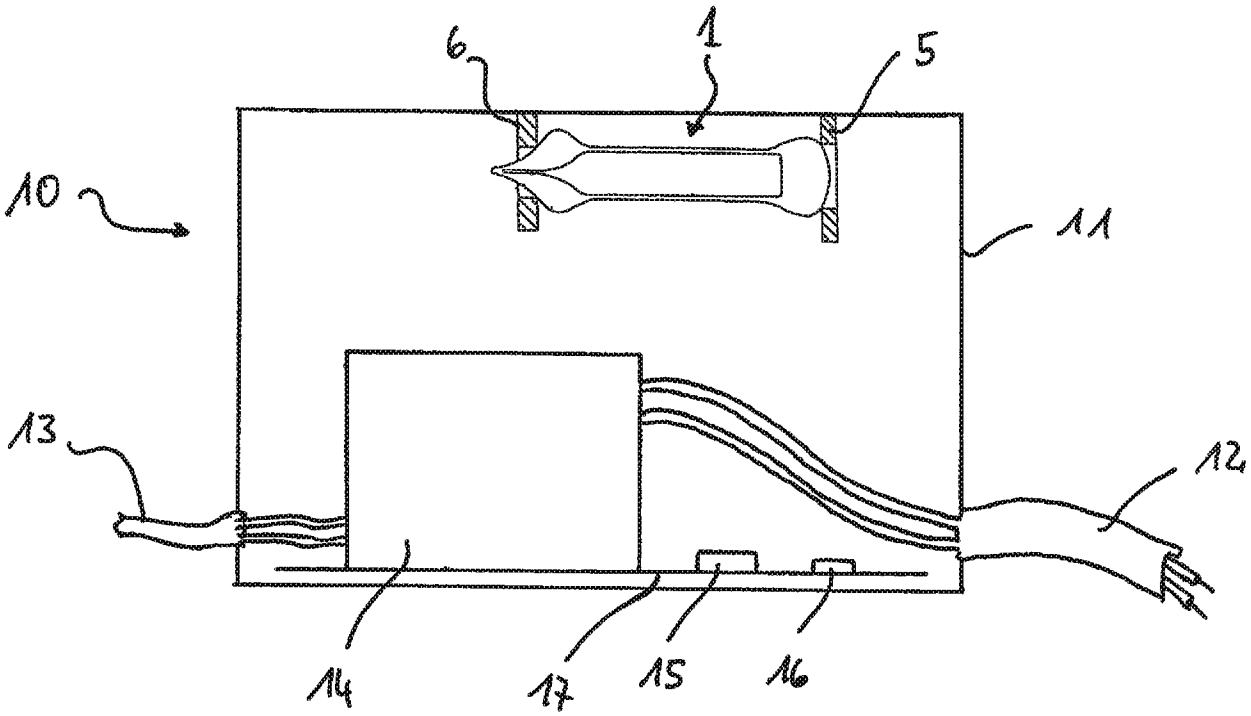
FIG. 4 a schematic representation of a small electrical device equipped with a fire protection device according to the invention; here, a power adaptor.

FIG. 4 shows a schematic representation of a power adaptor 10 as an example of a small electrical device according to the invention. The power adaptor 10 features a housing 11, in which the various components are disposed. A power cable 12 runs into the housing for connecting to the mains power supply. A unit cable 13 runs from the housing, which acts as a voltage-adapted power supply for the device. A voltage converter 14 and additional electrical components 15, 16 on a printed circuit board 17 are disposed within the housing 11. The voltage converter 14 is connected with the power cable 12 on the input side with both wires, and on the output side, the voltage converter 14 supplies the unit cable 13. A bursting capsule 1 according to FIG. 1 is disposed as a fire protection device within the housing 11 between supports 5 and 6. If overheating that exceeds trigger temperature of the bursting capsule 1 now occurs in the power adaptor 10 as a result of a malfunction, the liquid disposed in the hollow space of the bursting capsule 1 causes the bursting capsule to rupture and thus develops its fire inhibiting effect or extinguishing effect.

Figure 5:
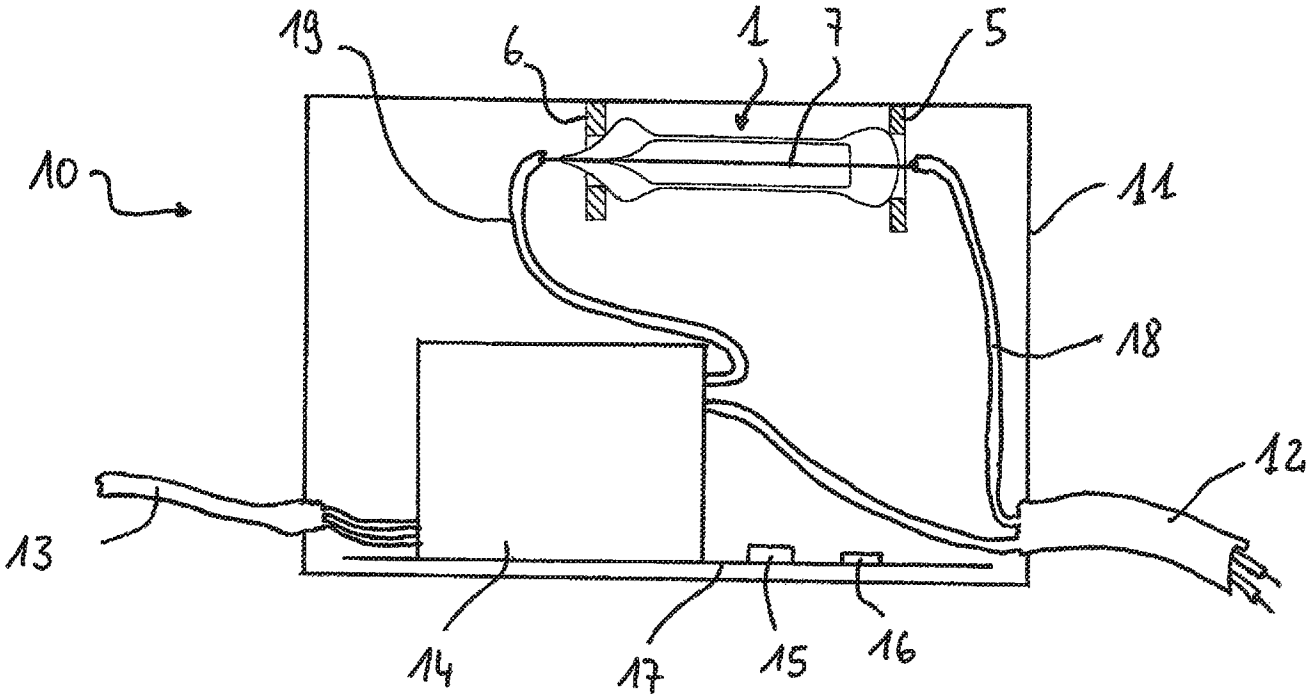
FIG. 5 an alternative embodiment of a small electrical device equipped with a fire protection device according to the invention; here again, a power adaptor.

FIG. 5 shows an alternative embodiment of a small electrical device according to the invention in the form of a power adaptor 10. Here again, the power adaptor 10 is enclosed by a housing 11, into which a power cable 12 extends that is connected to the mains voltage on the input side, from which the unit cable 13 extends with the device voltage adapted to the conditions for the electrical device being supplied. Again the voltage converter 14 and additional electrical components 15, 16 are disposed on a printed circuit board 17. In contrast to the preceding embodiment, both wires of the power cable 12 are no longer directly connected to the voltage converter 14, but rather, one wire 18 is routed to the bursting capsule 1, which here is designed in accordance with the embodiment in FIG. 2, and connected to the electrical conductor 7 formed there in this embodiment. Connected on the opposite side to the electrical conductor 7 is an additional wire 19 from a connection cable, which then runs to the input of voltage converter 14. This design, which varies from the embodiment in FIG. 4, ensures that in the event that the bursting capsule 1 is triggered, the electric conductor 7 will break, thereby interrupting the supply voltage to the power adaptor 10 from the power cable 12. Here, in addition to the fire inhibiting effect or extinguishing effect from the liquid disposed in the bursting capsule 1, it is also guaranteed that the power is also interrupted in the manner of a fuse. Naturally an embodiment of the bursting capsule 1 according to FIG. 2 could be replaced with the design in FIG. 3 in the embodiment according to FIG. 5 with the same effect.

In particular, it is to be understood here that the volume ratios between the volume of the hollow space of the bursting capsule to the total volume of the housing shown in FIGS. 4 and 5 are not to scale. Here, the bursting capsule 1 has been enlarged for better illustration. In so doing, the volume capacity of the bursting capsule 1 has been designed in such a way that upon triggering and the vaporizing of the liquid form of the chemical substance contained therein, said liquid, which is then in a gaseous state, will reliably fill the internal volume of the housing 11.

LIST OF REFERENCE DRAWINGS

1 bursting capsule
2 hollow space
3 end
4 end
5 support
6 support
7 electrical conductor
8 electrically conductive coating
10 power adaptor
11 housing
12 power cable
13 unit cable
14 voltage converter
15 electrical component
16 electrical component
17 printed circuit board
18 wire
19 wire

The invention claimed is:

1. A fire protection device for a small electrical device, where the small electrical device includes a housing and electrical components arranged within an interior of the housing; wherein the fire protection device comprises:

a bursting capsule located within the interior of the housing; said bursting capsule featuring a hollow space that is completely enclosed and delimited by a vessel wall, wherein a liquid is disposed in the hollow space, which a) breaks the vessel wall of the bursting capsule at a predetermined trigger temperature due to thermal expansion thereby causing the bursting capsule to rupture; wherein the liquid within the bursting capsule is released into the interior of the housing; and b) has a fire preventing effect and/or an extinguishing effect; and wherein the fire protection device further includes an electrical conductor routed between two contact points formed on the bursting capsule, which electrical conductor is connected between a voltage supply and the electrical components within the housing and the conductor conducts current to the electrical components; and wherein the electrical conductor is formed in such a way that the electrical conductor is automatically and inadvertently destroyed when the bursting capsule ruptures, thereby cutting power to the electrical components of the small electrical device located within the housing.

2. The fire protection device according to claim 1, wherein in addition to the liquid, a gas bubble is also disposed in the hollow space.

3. The fire protection device according to claim 1, wherein the liquid reaches boiling point at a temperature below the trigger temperature.

4. The fire protection device according to claim 1, wherein the liquid is a fluorinated ketone.

5. The fire protection device according to claim 4, wherein the fluorinated ketone is a perfluorinated ethyl isopropyl ketone.

6. The fire protection device according to claim 2, wherein the gas bubble disposed in the hollow space is comprised of a gas that does not promote fire.

7. The fire protection device according to claim 6, wherein the gas in the gas bubble is comprised of nitrogen or carbon dioxide.

8. The fire protection device according to claim 1, wherein the liquid turns to foam when the bursting capsule ruptures.

* * * * *